US008057278B2

(12) United States Patent
Allen et al.

(10) Patent No.: US 8,057,278 B2
(45) Date of Patent: Nov. 15, 2011

(54) WIRE-FREE BRASSIERE

(75) Inventors: Donald R. Allen, Wantage, NJ (US); Patricia E. McLaurin, Bayonne, NJ (US)

(73) Assignee: Warnaco U.S., Inc., Milford, CT (US)

( * ) Notice: Subject to any disclaimer, the term of this patent is extended or adjusted under 35 U.S.C. 154(b) by 392 days.

(21) Appl. No.: 12/425,012

(22) Filed: Apr. 16, 2009

(65) Prior Publication Data

US 2010/0267313 A1 Oct. 21, 2010

(51) Int. Cl.
*A41B 3/00* (2006.01)

(52) U.S. Cl. ..... 450/39; 450/92; 450/93

(58) Field of Classification Search ..... 450/54–58, 450/37, 39, 92, 93, 41, 43, 53, 60; 2/267, 2/268

See application file for complete search history.

(56) References Cited

U.S. PATENT DOCUMENTS

| | | | | |
|---|---|---|---|---|
| 2,915,067 | A * | 12/1959 | Bracht | 450/45 |
| 3,421,515 | A * | 1/1969 | Schaefer | 450/53 |
| 4,632,118 | A * | 12/1986 | Garutso | 450/53 |
| D373,237 | S | 9/1996 | Vass-Betts | |
| 6,203,400 | B1 | 3/2001 | Allen et al. | |
| D452,765 | S | 1/2002 | Kim | |
| D452,985 | S | 1/2002 | Kim | |
| 6,375,538 | B1 | 4/2002 | Allen et al. | |
| 6,547,636 | B1 | 4/2003 | Cato | |
| D491,339 | S | 6/2004 | Saviss | |
| 6,805,610 | B2 * | 10/2004 | Luk | 450/54 |
| 7,044,829 | B1 * | 5/2006 | Jagaric et al. | 450/54 |
| 7,192,332 | B2 * | 3/2007 | Liu | 450/39 |
| 7,244,167 | B2 * | 7/2007 | Falla | 450/54 |
| 7,390,239 | B1 * | 6/2008 | Huang | 450/39 |
| 7,407,428 | B2 * | 8/2008 | Fildan et al. | 450/41 |
| 7,429,205 | B1 * | 9/2008 | Huang | 450/39 |
| D579,177 | S | 10/2008 | Paul | |
| D587,878 | S | 3/2009 | Higo et al. | |
| 7,604,526 | B2 * | 10/2009 | Liu | 450/39 |
| 2004/0142633 | A1 * | 7/2004 | Luk | 450/39 |

OTHER PUBLICATIONS

Notice of Allowability for a Design Application and Notice of References Cited dated Aug. 17, 2009, from corresponding U.S. Appl. No. 29/335,492.

* cited by examiner

*Primary Examiner* — Gloria Hale
(74) *Attorney, Agent, or Firm* — Katten Muchin Rosenman LLP

(57) ABSTRACT

A lightweight, substantially unpadded, comfortable, push-in, wire-free bra has, when worn by a female wearer, a front including a pair of cups. Each cup defines upper inner and outer portions, lower inner and outer portions, a top, and a bottom, and is configured and dimensioned to hold substantially one breast of a female wearer. Each cup includes a sling portion that is designed to provide lateral support to the respective breast. In this manner, the sling portions bias the cup upper outer portions inwardly to provide push-in cleavage on the wearer's breasts. Straps are secured to the front for releasably supporting it on a female wearer with the breasts of the female wearer substantially within the cups.

13 Claims, 7 Drawing Sheets

WIRE-FREE BRASSIERE

BACKGROUND OF THE INVENTION

The present invention relates to a wire-free brassiere, and more particularly to a lightweight, substantially unpadded, comfortable, wire-free bra.

A wide variety of wire-free or non-underwire bras is well-known in the bra art. The use of a non-underwire bra, as opposed to an underwire bra, is to reduce discomfort to a wearer typically caused by an underwire, while continuing to provide adequate breast support. As such, a non-underwire bra is typically more useful to women having relatively small breasts, for whom the shoulder straps of the bra are likely to provide an adequate amount of support to the breasts.

However, there are two shortcomings which are often manifested in conventional wire-free bras—adequacy of support and the aesthetics of the wearer's appearance. The reduction in support to the breasts may cause discomfort to the wearer, if the weight of the breasts is not adequately supported, or if the weight of the breasts pulls too heavily upon the shoulder straps of the bra. Additionally, the reduction in support to the breasts may cause an apparent sagging effect on the breasts, or a flattening of the breasts against the chest of the wearer, thus reducing the physical attractiveness of the wearer's appearance.

Despite the wide variety of wire-free bras in the prior art, the need remains for such a bra which is lightweight, substantially unpadded, comfortable and designed to provide sufficient support to the breasts as well as a push-in effect which accentuates cleavage.

Accordingly, it is an object of the present invention to provide a lightweight, substantially unpadded, comfortable, push-in, wire-free bra which provides deeply plunging cleavage while enabling substantial independent motion of the cups (and hence the wearer's breasts) relative to one another.

SUMMARY OF THE INVENTION

In one aspect, the invention provides a wire-free bra. When worn by a wearer, the bra comprises a front, including a pair of cups and a front connecting portion; and a means secured to the front for releasably supporting the front on the wearer. Each of the cups defines an upper inner portion, an upper outer portion, a lower inner portion, a lower outer portion, a top connecting the upper inner and outer portions, and a bottom connecting the lower inner and outer portions. Each cup is configured and dimensioned to hold substantially one breast of the wearer. The cups are connected at the front only by the front connecting portion, thereby to provide a deeply plunging cleavage and to enable substantial independent motion of the cups relative to one another.

The cups and the front connecting portion are devoid of an underwire, thereby providing comfort to the wearer. Each cup further includes an outer fabric liner portion, a first skived foam layer, and a second skived foam layer. The outer fabric liner portion completely covers the first and second skived foam layers. Each cup further includes a sling portion. The sling portion is sandwiched between the first and second skived foam layers. The sling portion is completely covered by the outer fabric portion such that said sling portion is not visible to the wearer. The sling portion is configured to provide support to the respective breast.

Each sling portion may be positioned to provide lateral support to the respective breast, thereby tending to push the respective breast inward. Alternatively, or additionally, each sling portion may be positioned to provide vertical support to the respective breast, thereby tending to push the respective breast upward. Each sling portion may comprise an elastic material, such as a nylon/spandex mesh or fabric or a fabric with a mechanical stretch made of 100% nylon.

The cups may be devoid of substantial padding. Alternatively, to the extent that the cups contain padding, the padding may be uniformly distributed over substantially the entire surface of said cups.

For each cup, an edge of the upper inner portion may extend arcuately downwardly and arcuately inwardly toward the front connecting portion; thereby further defining said deeply plunging cleavage. The front connecting portion may terminate at said cup lower inner portion without appreciable ascent toward the cup upper inner portion. The front connecting portion may be configured and dimensioned to snugly fit the wearer between and below the breasts.

The supporting means may include a backstrap secured at each end to the respective lower outer portion of one of the cups and a pair of shoulder straps connecting the cup tops to the backstrap.

In another aspect of the invention, a push-in wire-free bra is provided. When worn by a wearer, the bra comprises a front, including a pair of cups and a front connecting portion; and a means secured to the front for releasably supporting the front on a wearer. Each cup defines an upper inner portion, an upper outer portion, a lower inner portion, a lower outer portion, a top connecting said upper inner and outer portions, and a bottom connecting said lower inner and outer portions. Each cup is configured and dimensioned to hold substantially one breast of a wearer. The cups are connected at the front only by the front connecting portion, thereby providing a deeply plunging cleavage and enabling substantial independent motion of said cups relative to one another. The supporting means includes a backstrap secured at each end to the respective lower outer portion of one of the cups and a pair of shoulder straps connecting the cup tops to the backstrap.

The upper inner portions extend arcuately downwardly and arcuately inwardly toward the front connecting portion, thereby further defining said deeply plunging cleavage. The front connecting portion terminates at the cup lower inner portion without appreciable ascent toward the cup upper inner portion. The front connecting portion is configured and dimensioned to snugly fit the wearer between and below the breasts. The cups and the front connecting portion are devoid of an underwire, thereby providing comfort to the wearer.

Each cup includes an outer fabric liner portion, a first skived foam layer, and a second skived foam layer. The outer fabric liner portion completely covers the first and second skived foam layers.

Each cup further includes a sling portion. The sling portion comprises an elastic material, such as a nylon/spandex mesh or fabric or a fabric with a mechanical stretch made of 100% nylon. The sling portion is sandwiched between the first and second skived foam layers. The sling portion is completely covered by the outer fabric liner portion such that said sling portion is not visible to the wearer. The sling portion is positioned to provide vertical and lateral support to the respective breast, thereby tending to push the respective breast upward and inward.

The cups may be devoid of substantial padding. Alternatively, to the extent that the cups contain padding, the padding may be uniformly distributed over substantially the entire surface of the cups.

BRIEF DESCRIPTION OF THE DRAWINGS

The above and related objects, features, and advantages of the present invention will be more fully understood by reference to the following detailed description of the presently preferred, albeit illustrative, embodiments of the present invention when taken in conjunction with the accompanying drawings wherein.

DETAILED DESCRIPTION OF THE INVENTION

Figure 1:
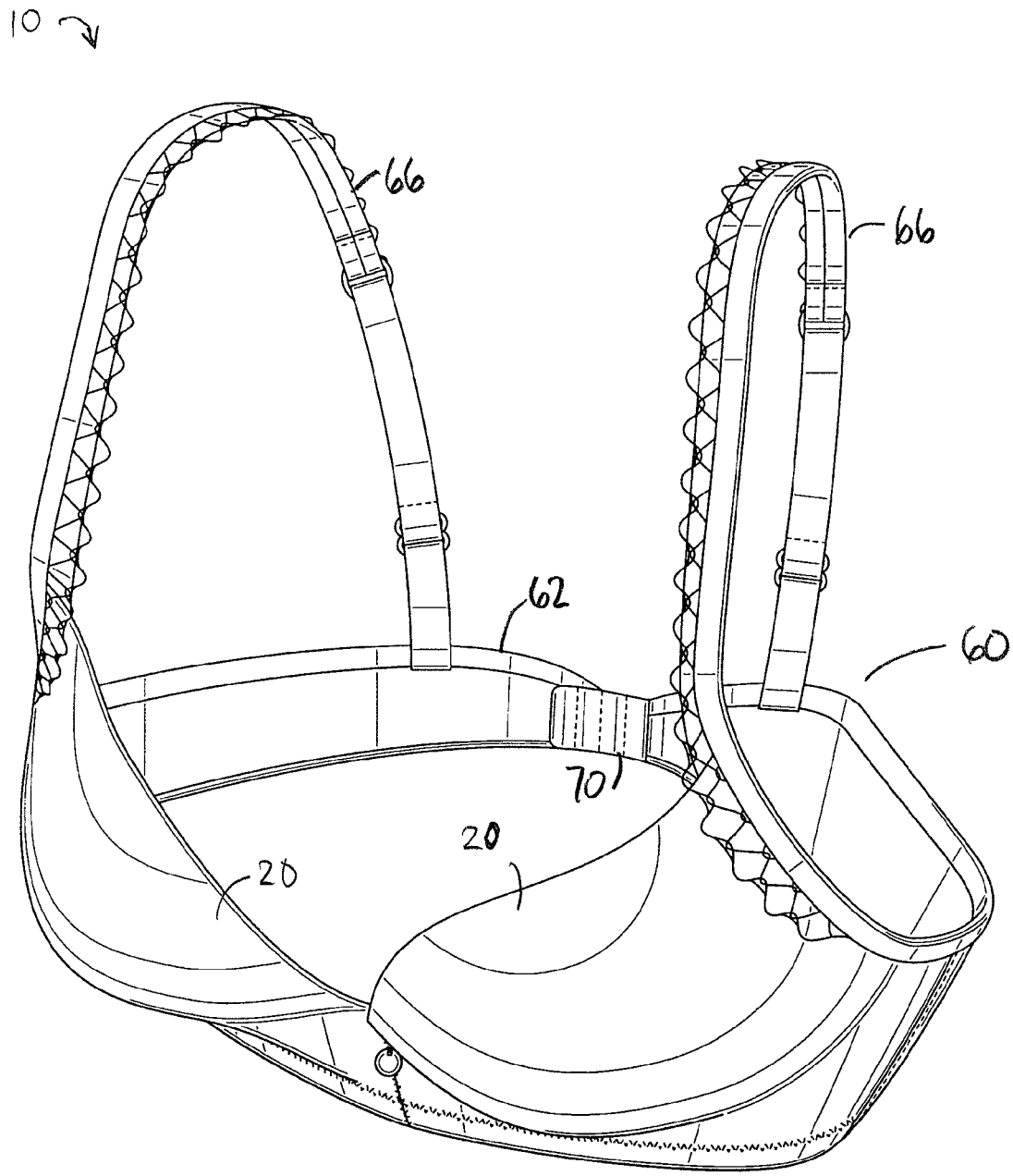
FIG. 1 is an isometric view of a bra according to the present invention, showing the bra on a wearer illustrated in phantom line.
Figure 2:
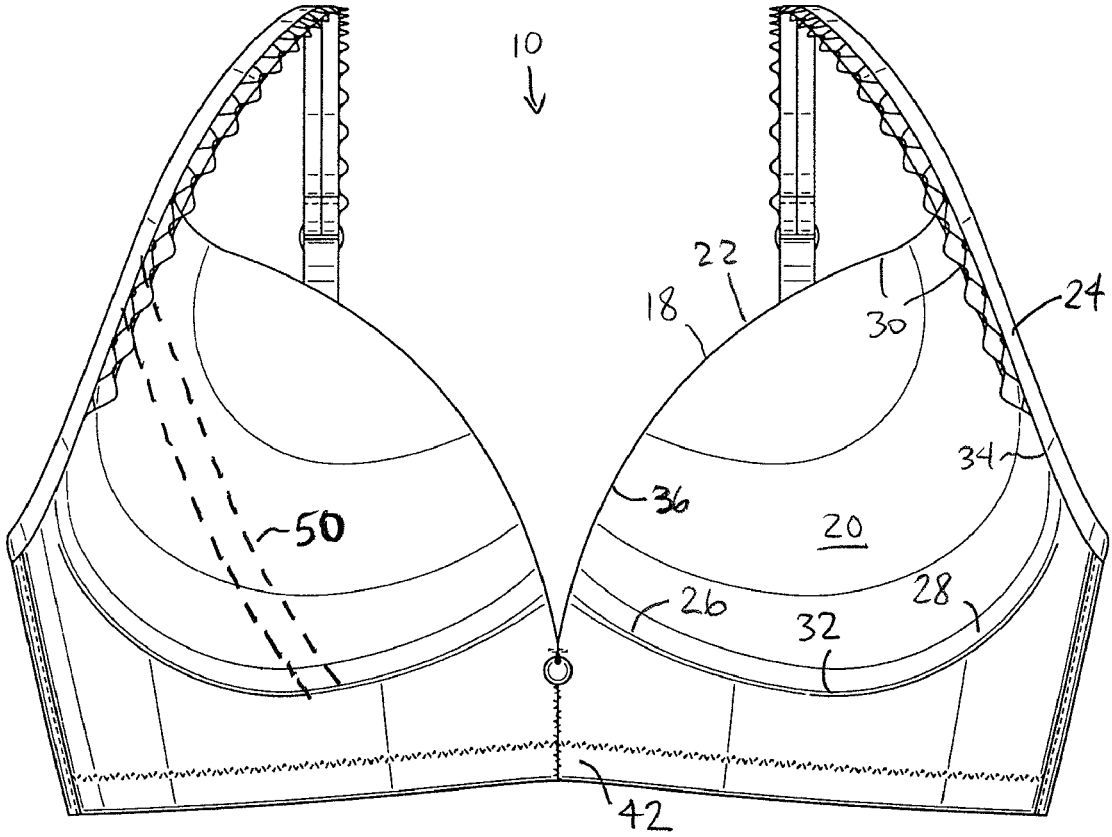
FIG. 2 is a front elevational view of a bra according to the present invention.
Figure 3:
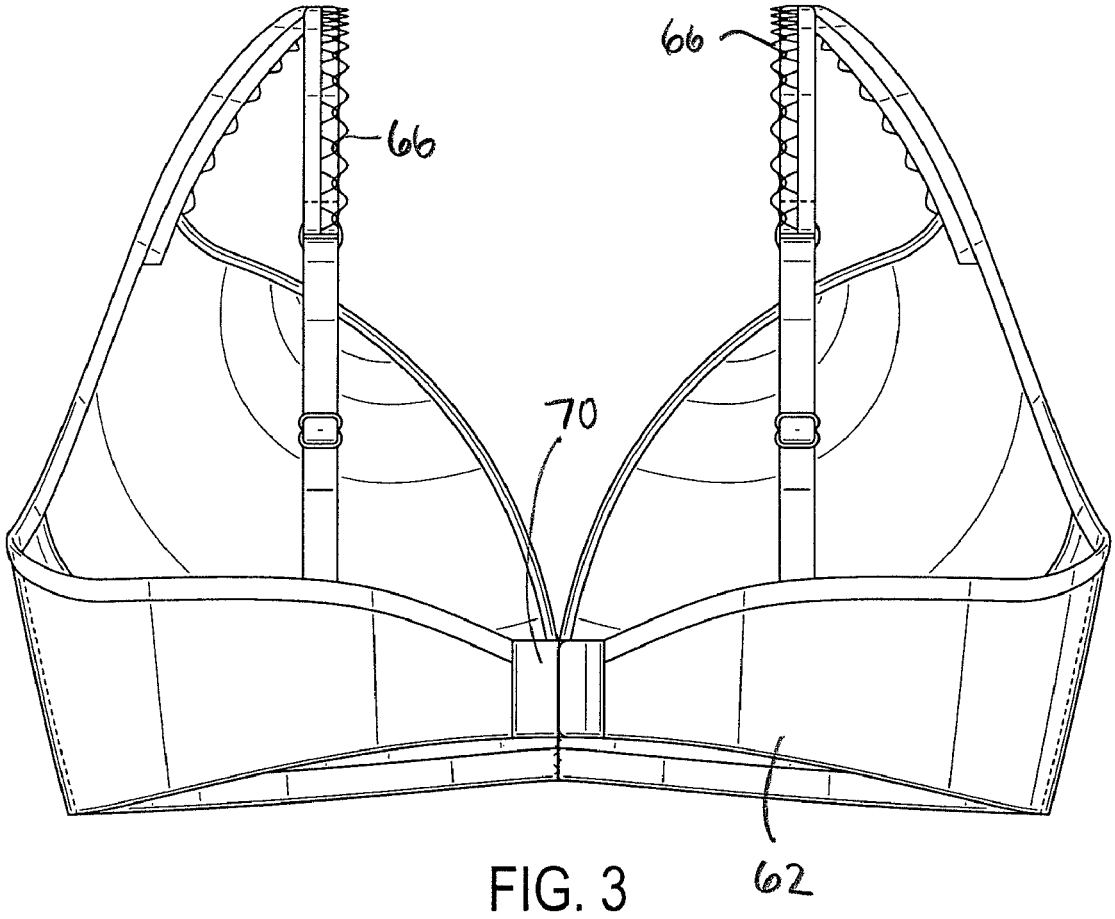
FIG. 3 is a back elevational view thereof.
Figure 4:
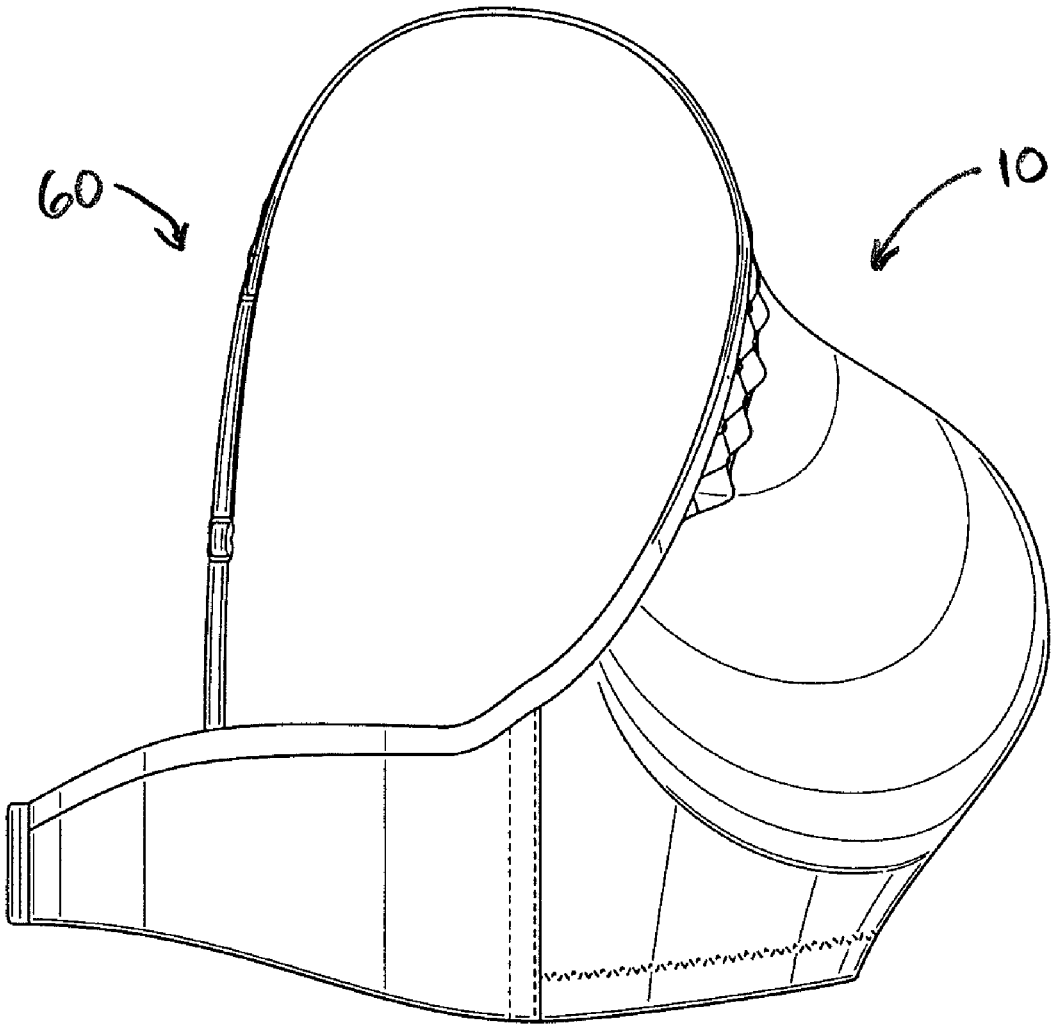
FIG. 4 is a right-side elevational view thereof.
Figure 5:
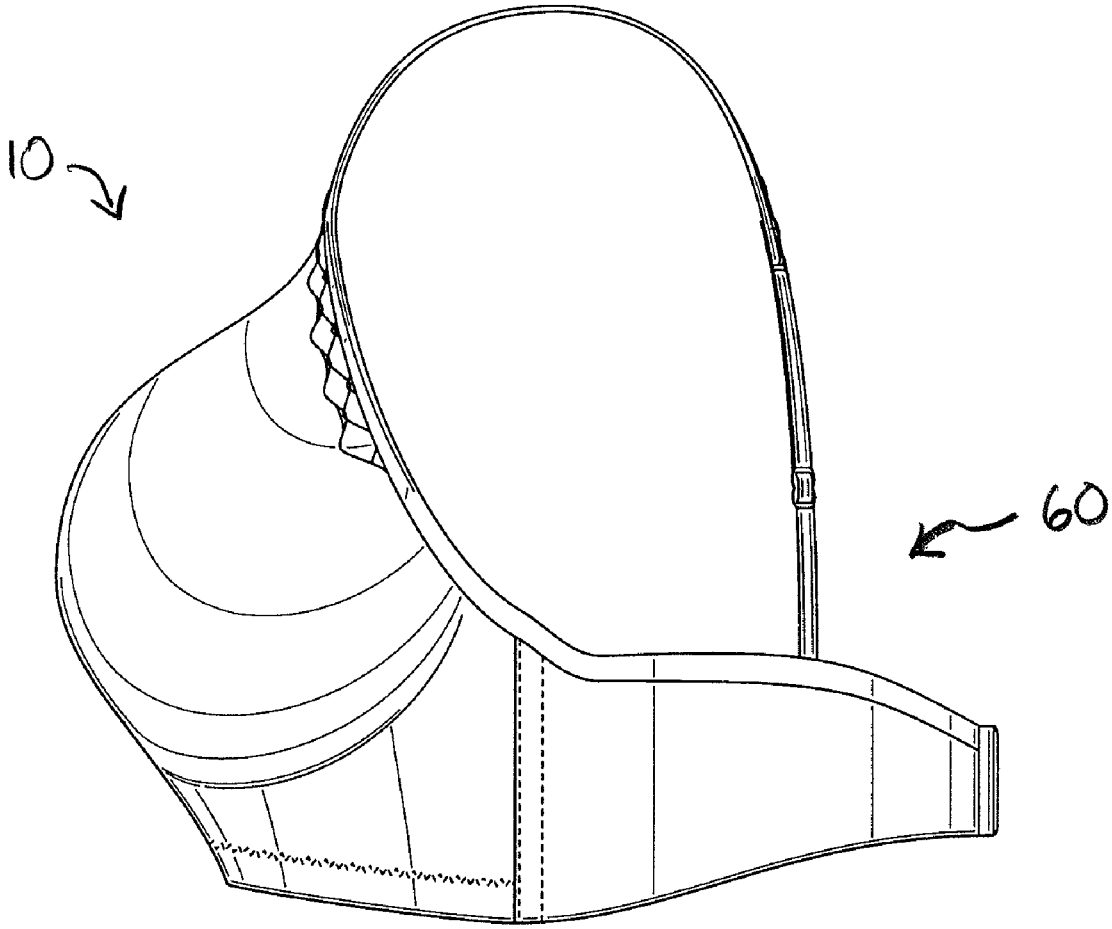
FIG. 5 is a left-side elevational view thereof.
Figure 6:
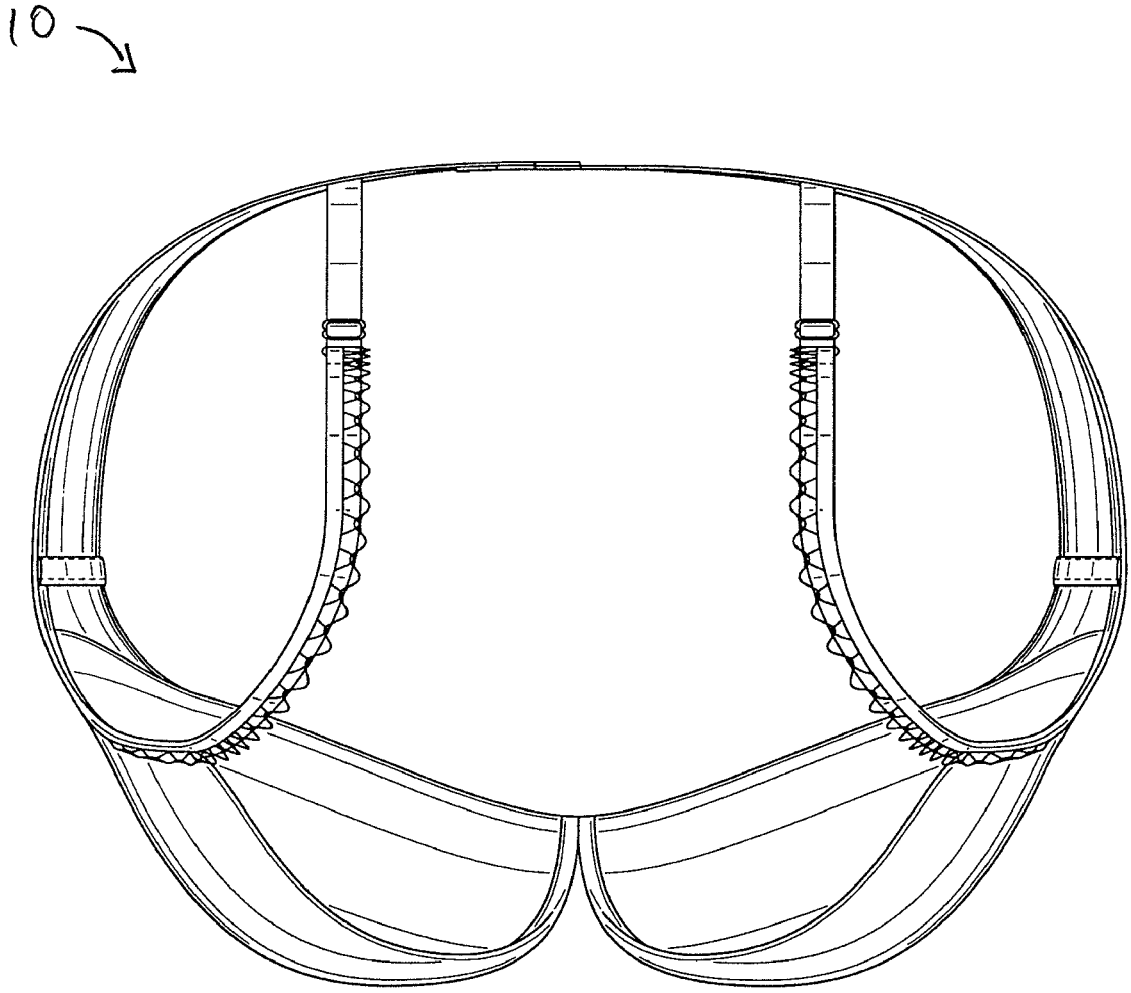
FIG. 6 is a top plan view thereof.
Figure 7:
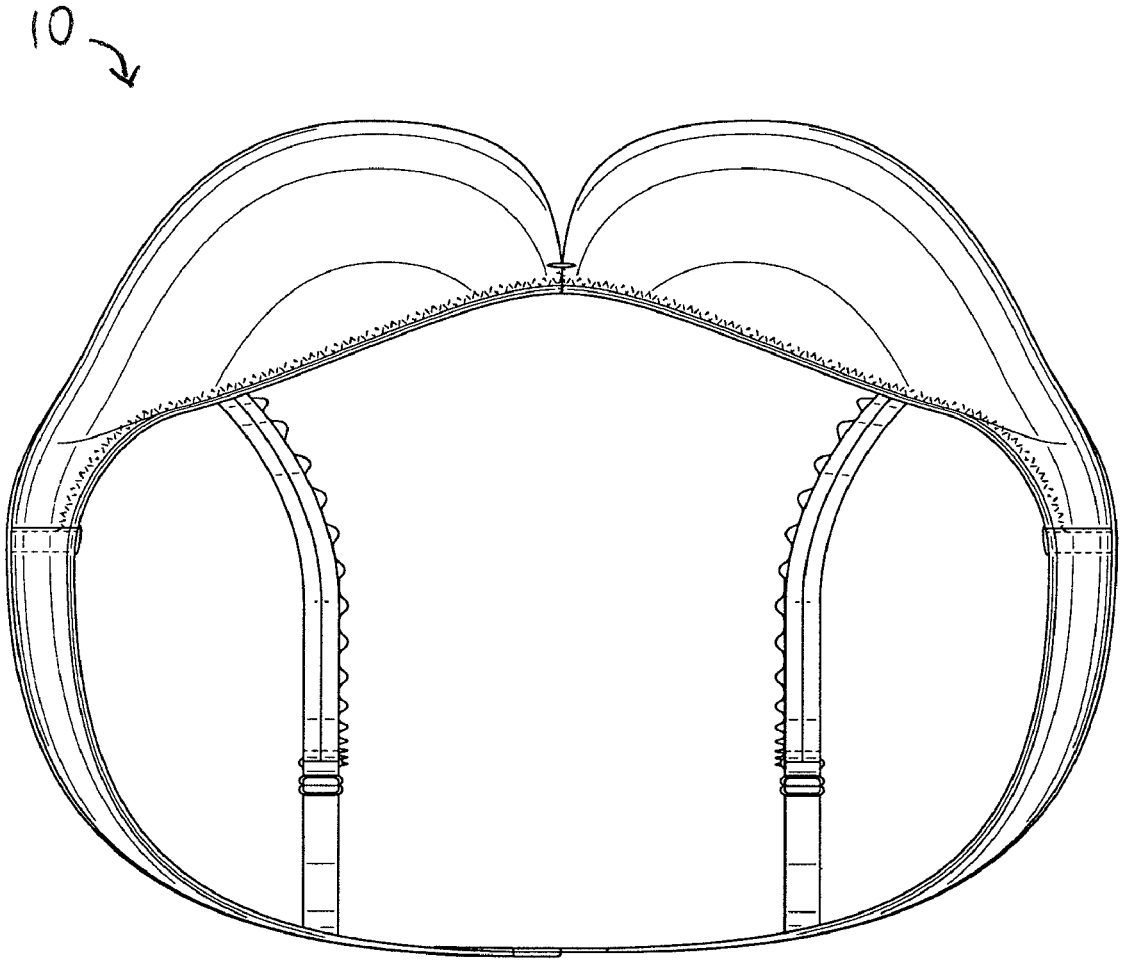
FIG. 7 is a bottom plan view thereof.

Referring now to the drawings, and in particular to FIG. 1 thereof, therein illustrated is a lightweight, substantially unpadded, comfortable, push-in wire-free bra according to the present invention, generally designated by the reference numeral 10.

When worn by a female wearer 12 having breasts 14, the bra 10 comprises a front generally designated 18. As best seen in FIGS. 2-7, the front 18 includes a pair of cups 20, each cup defining upper inner and outer portions 22, 24, lower inner and outer portions 26, 28, a top 30 connecting the upper inner and outer portions 22, 24, and a bottom 32 connecting the lower inner and outer portions 26, 28. The front 18 also includes a front connecting portion 42. The cups 20 are connected at the front 18 by the front connecting portion 42.

Each cup 20 is configured and dimensioned to hold substantially one breast 14 of a female wearer 12. Preferably the top 30 is somewhat chevron shaped, and the bottom 32 is somewhat convexly curved. The lateral or outer side 34 may be substantially linear or somewhat convexly curved, and the medial or inner side 36 also may be substantially linear or somewhat convexly curved below the top 30—that is, between the upper inner portion 22 and the lower inner portion 26.

The cups 20 are devoid of substantial padding and, to the extent that the cups do contain padding, the padding is uniformly distributed over substantially the entire surface of the cups. More particularly, the cups 20 may be formed of one or more relatively thin layers of foam material. In a preferred embodiment, the foam material is manufactured using a skiving process, and each cup 20 includes a first skived foam layer and a second skived foam layer. Soft and smooth liners (one adjacent the breast and one spaced from the breast) may define the major outer surfaces of the cup to provide comfort to the wearer and present an aesthetic quality to a viewer. The liners are preferably made using a fabric.

Each cup 20 defines an edge of said upper inner portion 22, which extends arcuately downwardly and arcuately inwardly toward the front connecting portion 42. The front connecting portion 42 is configured and dimensioned to snugly fit the wearer between and below the breasts 14. Further, the front connecting portion 42 terminates at a respective cup lower inner portion 26 without appreciable ascent towards the cup upper inner portion 22. As the cups 20 are connected at the front 18 only by the front connecting portion 42, a deeply plunging cleavage is provided and substantial independent motion of the two cups 20 relative to one another is made possible. The cleavage is considered aesthetically desirable, and the substantially independent mobility of the cups contributes to the comfort of wearing the bra 10.

For each cup 20, a sling portion 50 is provided. The sling portion 50 is thin, and it is preferably sandwiched between the first and second skived foam layers. In addition, the sling portion 50 is completely covered by the outer fabric liner. In this manner, the sling portion is positioned so that it is not visible to the wearer or a viewer. The sling portion is preferably connected between a selected point along the upper inner portion 22 or upper outer portion 24 and another selected point near the point where the lower inner portion meets the lower outer portion. The connection points are preferably selected such that sling portion 50 is oriented at an angle which is on a diagonal with respect to a vertical axis of the wearer, the diagonal being closer to the vertical than to the horizontal. By orienting the sling portion at an appropriate diagonal angle, the sling portion 50 is thus configured to provide lateral support to the respective breast, or to provide vertical and lateral support to the breast. The sling portion 50 may be made of an elastic material or any material deemed suitable.

The sling portion 50 biases the cup upper outer portion 24 inwardly or medially so that the two sling portions 50 cooperatively bias the cup upper outer portions 24 inwardly to provide an inwardly directed push-in cleavage on the upper portions 22, 24 of a wearer's breasts 14. To a lesser degree the sling portion 50 further biases the cup lower outer portion 28 inwardly so that the two sling portions 50 cooperatively bias the cup lower outer portions 28 inwardly to provide a medially directed push-in cleavage on the lower portions 22, 26 of a wearer's breast 14. The cleavage is produced not by any padding of the bra, but rather by the sling portions 50 biasing the two breasts 14 towards each other.

The bra 10 additionally includes conventional support means 60 secured to the front 18 for releasably supporting the front 18 on a female wearer 12 with the breasts 14 of the female wearer substantially within the cups 20. More particularly, support means 60 typically includes a backstrap 62 and, optionally, a pair of shoulder straps 66. Preferably the backstrap 62 extends around the back and sides of the wearer 12 and includes two strap portions and an adjustable and releasable connector—for example, a plurality of hook and eye mechanisms 70—to join the free ends of the two strap portions not secured at a respective cup outer portion 24, 28. The shoulder straps 66 are adjustable in length and connect the cup tops 30 to the backstrap 62.

The bra 10 provides a highly desirable deeply plunging cleavage which extends downwardly all the way to the front connecting portion 42 so that it can be worn with a wide variety of different clothing styles including decollete styles. The bra 10 avoids the "double breast" appearance of the conventional push-up bra since the bra relies upon a lateral pushing of the breast towards one another to create a cleavage in the center. The bra 10 is lightweight relative to the conventional push-up bra due to the lack of an underwire. The bra 10 is exceptionally comfortable to wear and this is believed to be a result of the production of a push-in (rather than a push-up) effect to produce cleavage, as well as a further result of the lack of an underwire.

To summarize, the present invention provides a lightweight, substantially unpadded, comfortable, push-up, wire-free bra which provides deeply plunging cleavage while enabling substantially independent motion of the cups (and hence the breasts) relative to one another.

Now that the preferred embodiments of the present invention have been shown and described in detail, various modifications and improvements thereon will be clearly apparent to those skilled in the art. Accordingly, the spirit and scope of the present invention is to be construed broadly and limited only by the appended claims, and not by the foregoing specification.

What is claimed is:

1. An underwire-free bra comprising, when worn by a wearer:

a front comprising a pair of cups, each cup comprising an upper inner portion, an upper outer portion, a lower inner portion, and a lower outer portion, each cup being configured and dimensioned to hold substantially one breast of a wearer, each inner portion being proximal to a cleavage of the wearer and each outer portion being distal from the cleavage of the wearer, a top connecting the upper inner portion and the upper outer portion, and a bottom connecting the lower inner portion and the lower outer portion;

a front connecting portion, said cups being connected at said front only by said front connecting portion to provide a deeply plunging cleavage and enable substantial independent motion of said cups relative to one another;

means secured to said front for releasably supporting said front on a wearer, said cups and said front connecting portion being devoid of an underwire for providing comfort to the wearer, wherein each said cup includes an outer fabric liner portion, a first skived foam layer, and a second skived foam layer, the outer fabric liner portion completely covering the first and second skived foam layers; and wherein each said cup further includes a sling portion, said sling portion being sandwiched between said first and second skived foam layers, said sling portion being completely covered by the outer fabric liner portion such that said sling portion is not visible to the wearer; and said sling portion being configured to provide support to the respective breast.

2. The bra of claim 1, wherein each said sling portion is positioned to provide a support inwardly in a plane parallel to a skin of surface of the wearer's breasts to a central cleavage area between the breasts of the wearer.

3. The bra of claim 1, wherein each sling portion is positioned to provide an upward push to the respective breast.

4. The bra of claim 1, wherein each sling portion comprises one of a mesh or a fabric.

5. The bra of claim 1, wherein each cup comprises only padding consisting of the first skived foam layer and the second skived foam layer.

6. The bra of claim 1, wherein the cup comprises a third padding in addition to the first skived foam layer and the second skived foam layer, the third padding being uniformly distributed over substantially the entire surface of the cups.

7. The bra of claim 1, wherein each upper inner portion comprises an edge that extends arcuately downwardly and arcuately inwardly toward the front connecting portion for defining said deeply plunging cleavage.

8. The bra of claim 1 wherein said front connecting portion terminates at said cup lower inner portion without appreciable ascent toward said cup upper inner portion.

9. The bra of claim 1 wherein said front connecting portion is configured and dimensioned to snugly fit the wearer between and below the breasts.

10. The bra of claim 1 wherein said supporting means includes a backstrap secured at each end to the respective lower outer portion of one of said cups and a pair of shoulder straps connecting said cup tops to said backstrap.

11. A push-in underwire-free bra comprising, when worn by a wearer:

a front comprising a pair of cups, each cup defining an upper inner portion, an upper outer portion, a lower inner portion, and a lower outer portion, each cup being configured and dimensioned to hold substantially one breast of a wearer, each inner portion being proximal to a cleavage of the wearer and each outer portion being distal from the cleavage of the wearer, a top connecting the upper inner portion and the upper outer portion, and a bottom connecting the lower inner portion and the lower outer portion;

a front connecting portion, said cups being connected at said front only by said front connecting portion to provide a deeply plunging cleavage and enable substantial independent motion of said cups relative to one another; and means secured to said front for releasably supporting said front on a wearer, said supporting means including a backstrap secured at each end to the respective lower outer portion of one of said cups and a pair of shoulder straps connecting said cup tops to said backstrap;

said upper inner portions extending arcuately downwardly and arcuately inwardly toward the front connecting portion for defining said deeply plunging cleavage;

said front connecting portion terminating at said cup lower inner portion without appreciable ascent toward said cup upper inner portion, and said front connecting portion being configured and dimensioned to snugly fit the wearer between and below the breasts;

said cups and said front connecting portion being devoid of an underwire for providing comfort to the wearer, wherein each said cup includes an outer fabric liner portion, a first skived foam layer, and a second skived foam layer, the outer fabric liner portion completely covering the first and second skived foam layers; and wherein each said cup further includes a sling portion, said sling portion comprising one of a mesh or a fabric, said sling portion being sandwiched between said first and second skived foam layers, said sling portion being completely covered by the outer fabric portion such that said sling portion is not visible to the wearer; and said sling portion being positioned to provide vertical and lateral support to the respective breast, thereby tending to push the respective breast upward and inward.

12. The bra of claim 11, wherein each cup comprises only padding consisting of the first skived foam layer and the second skived foam layer.

13. The bra of claim 11, wherein the cup comprises a third padding in addition to the first skived foam layer and the second skived foam layer, the third padding being uniformly distributed over substantially the entire surface of the cups.

* * * * *